United States Patent [19]

Hafner et al.

[11] Patent Number: 4,478,196

[45] **Date of Patent: * Oct. 23, 1984**

[54] FUEL INJECTION PUMP FOR INTERNAL COMBUSTION ENGINES

[75] Inventors: Karl E. Hafner; Wolfgang Köhler, both of Cologne, Fed. Rep. of Germany

[73] Assignee: Klöckner-Humboldt-Deutz Aktiengesellschaft, Cologne, Fed. Rep. of Germany

[ * ] Notice: The portion of the term of this patent subsequent to Jul. 5, 1999 has been disclaimed.

[21] Appl. No.: 292,031

[22] Filed: Aug. 11, 1981

Related U.S. Application Data

[63] Continuation of Ser. No. 19,432, Mar. 12, 1979, Pat. No. 4,308,839.

[30] Foreign Application Priority Data

Mar. 10, 1978 [DE] Fed. Rep. of Germany ..... 2810335

[51] Int. Cl.[3] ..... F02M 59/10

[52] U.S. Cl. ..... 123/504; 123/496; 123/501

[58] Field of Search ..... 123/504, 501, 299, 300, 123/496

[56] References Cited

U.S. PATENT DOCUMENTS

| | | | |
|---|---|---|---|
| 1,862,132 | 6/1932 | Adams | 123/139 AC |
| 1,930,297 | 10/1933 | Welsh | 123/139 AC X |
| 1,988,533 | 1/1935 | Woolson | 123/139 AC |
| 2,016,879 | 10/1935 | Vincent | 123/139 AC |
| 2,628,607 | 2/1953 | Newell | 123/139 AC |
| 4,308,839 | 1/1982 | Hafner | 123/504 |

FOREIGN PATENT DOCUMENTS

| | | | |
|---|---|---|---|
| 273329 | 2/1928 | United Kingdom | 123/32.6 |

*Primary Examiner*—Charles J. Myhre
*Assistant Examiner*—Carl Stuart Miller
*Attorney, Agent, or Firm*—Becker & Becker, Inc.

[57] ABSTRACT

A fuel injection pump for combustion engines with at least one pump piston which is actuated by a cam mounted on a mechanically operable camshaft is disclosed. The piston stroke is utilized only in part for delivery of the fuel, whereby the fuel feed volume is controllable by changing the effective piston stroke. The fuel injection pump also includes a control element which, in conformity with the number of revolutions of the combustion engine, varies the first derivative of the function of the effective piston stroke in accordance with the cam angle.

4 Claims, 14 Drawing Figures

FUEL INJECTION PUMP FOR INTERNAL COMBUSTION ENGINES

Figure 1:
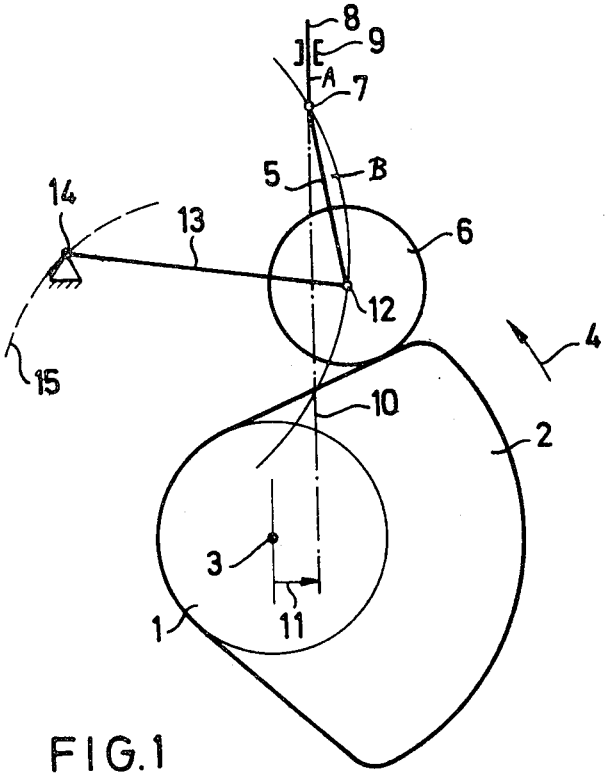

This is a continuation application of co-pending parent application Ser. No. 19,432-Hafner et al. filed Mar. 12, 1979 (Monday), now U.S. Pat. No. 4,308,839-Hafner et al. issued Jan. 5, 1982.

The present invention relates to a fuel injection pump, particularly for internal combustion engines, having a pump piston which is moved by the cam of a mechanically actuated camshaft, wherein the pump piston stroke is only partially used for fuel delivery, whereby the volume of fuel is controllable by varying the effective delivery stroke.

Conventional fuel delivery pumps include piston means which have control edges at their respective circumferences extending obliquely to the axis of the piston. These control edges cooperate with control bores in the pump cylinder. Rotation of the pump piston changes the effective delivery stroke of the unit.

It is further known to vary initiation and, thereby, the length of the effective delivery stroke of the pump piston, by provision of shunting or bypass pistons which have a controllable stroke. It is, furthermore, known to determine the delivery time of the pump piston by provision of positively controlled valves.

It is, furthermore, known to limit the length of the effective stroke of the pump piston by means of a rocking lever arranged between the pump piston and the cam.

It is also known to vary the stroke of the pump piston by the intervention of a power transmission means including a rocking lever arranged between the cam and the pump piston.

In the known fuel injection pumps, the delivery velocity is in conformity with the drive revolutions, i.e., the number of revolutions of the combustion engine. Thus, the pressure distribution in the injection valve, connected to the pump by an injection duct, as well as an injection distribution, are dependent on the number of revolutions of the combustion engine, namely, such that, at equal injection volumes, low injection pressures and relatively lengthy injection periods at a low number of revolutions are contrasted by high injection pressures and short injection periods at the nominal number of revolutions. Without considering dynamic influences, the fuel injection, in both cases, is carried out over the same region of angle of rotation of the cam or crank. Recent investigations have shown that these rigid conditions do not provide for an optimal operation behavior of the combustion engine over the entire performance graph.

Furthermore, primarily the delivery initiation determines the characteristic performance values of the combustion engine. Thus, measures often are taken which afford a variation of delivery initiation in conformity with the load and, as well, in conformity with the number of revolutions. Usually, the adjustment of the initiation, which is in conformity with the number of revolutions, is achieved by an injection governor or timing gear, which provides a revolution-dependent phase shift between the crank shaft and the camshaft. The injection governor or timing gear affords realization of the two requirements, namely, provision of a sensitive measuring device on the hand, and rigidity of a fuel injection pump clutch or transmission on the other hand, only with great effort. The revolution-dependent injection adjustments becomes even more difficult as the injection pressure increases, i.e., as the torque which are to be transmitted increase. This causes considerable difficulties, particularly in high pressure fuel injection.

It is an object of the present invention to provide a fuel injection pump in which initiation of fuel delivery and the fuel delivery velocity are optimized over the full range of operation of the combustion engine.

This object and other objects and advantages of the invention will appear more clearly from the following specification in connection with the accompanying drawings, in which:

FIGS. 1 to 5 show different embodiments of piston pump drive or actuating mechanisms; and FIGS. 6 to 14 show different layout possibilities of actuating mechanisms in accordance with FIG. 1 and corresponding diagrams of the pump piston stroke and the pump piston velocity with respect to the angle of the camshaft.

In accordance with the present invention there is provided a combustion engine which includes a control element which, in conformity with the number of revolutions, varies the first derivative of the function of the effective piston stroke, in accordance with the angle of the cam.

The fuel injection velocity is dependent on the pump piston velocity. The pump piston velocity represents the product of angular velocity of the camshaft and the first derivative of the function of stroke in conformity with the angle of rotation of the cam. In a situation where the camshaft is mechanically driven, the number of revolutions is a function of the number of revolutions of the crank shaft of the combustion engine. This is necessary so as to coordinate the fuel injection cycle and the working cycle of the combustion engine. However, in order to render the injection time or period and the injection velocity, selectable, in conformity with an optimum behavior of the combustion engine, according to the present invention, in the fuel injection pump, the first derivative of the function of the effective piston stroke is varied by a control element according to the cam angle. The injection process can thereby be adapted to provide a time-constant injection at constant load conditions.

In accordance with one embodiment of the invention, there is suggested a revolution-dependent idle stroke adjustment device and an injection governor or timing gear for compensating for shifting of the fuel injection time point, caused by the idle stroke adjustment device. Such an arrangement permits shifting of the effective stroke onto the cam lifting curve produced by the device, and, thereby, selection of a region which is particularly adapted for the performance values of the motor. The attendant shift of the injection time point is compensated for by the same device, so that the injection is carried out with optimum velocity, as well as at an advantageous point of time.

In accordance with another embodiment of the invention, the fuel injection pump is provided with a pump piston which has circumferential control edges. The control edges extend slopingly or helically, and are adapted to limit the effective stroke of the pump piston in cooperation with control bores in the pump cylinder. The device dependent upon revolution includes a swing or rocking lever as power transmission means arranged between the pump piston and the cam. The swing or rocking lever is adjustably journalled with its free end in a housing and follows the cam path with a centrally disposed contact roller. When the free end of the rocking lever is adjusted, the initiation position and, thereby, the delivery velocity and initiation of delivery by the piston are varied. The adjustment can be carried out in any desired manner, for example, by means of an eccentric cam.

Generally according to a further embodiment of the invention, provision is made to guide the contact roller by way of a crank or pawl of a breech mechanism or cam lever drive mechanism or power transmission means. When changing the drive geometry in conformity with the number of revolutions, there are attained regulation of initiation of delivery and also variation of the velocity of the pump piston during the effective stroke.

It is also possible that the roller shaft is pivotally joined to the pump piston and that a connecting rod is secured at the contact roller axis. The connecting rod at its other end has a link with a geometric locus which is locatable on a freely definable curve, e.g., an arc or a straight line, along which the link is movable in a manner dependent upon revolution.

It is further possible that the axis of the cam follower contact roller is guided in a parallel guide. A connecting rod is rigidly secured to the guide. The connecting rod is journalled in a swingably mounted longitudinal guide and is provided at its free end with a link having a geometric locus which is locatable on a freely definable curve and variable in a manner depedent upon revolution.

It is also possible that the longitudinal guide of the connecting rod is rigidly mounted.

It is also possible that the geometric locus of the swingable longitudinal guide is locatable on a freely definable curve and variable in a manner dependent upon revolution.

It is further possible that the axis of the cam follower contact roller is guided by a parallel guide which is swingable about a fixed pivot point and to which is secured one end of a connecting rod. The other end of the connecting rod has a link with a geometric locus which is locatable on a freely definable curve and variable in a manner dependent upon revolution.

It is also possible that the longitudinal guide of the connecting rod is rigidly mounted.

It is also possible that the longitudinal pump piston axis and the vertical axis of the cam shaft are spaced apart at a predetermined distance.

It is further possible that the roller shaft has a cam disc in contact with the cam follower contact roller. A connecting rod is securable at the axis of the contact roller. The other end of the connecting rod is in the form of a link having geometric locus which is locatable on a freely definable curve and variable in a manner dependent upon revolution.

Turning now to the drawings, wherein identical parts are designated by the same reference numerals, FIG. 1 shows diagrammatically a cam shaft 1 having a cam 2. The cam shaft 1 is rotatable about an axis 3 in the direction of arrow 4. The cam 2 actuates power transmission means comprising a roller shaft 5 having a roller 6. The roller shaft 5 is pivotally joined at 7 to a pump piston 8. The pump piston 8 is axially movable in a piston cylinder 9. The vertical piston axis 10 is positioned at a distance, designated by numeral 11, from axis 3 of the cam shaft 1. A connecting rod 13 or rocking lever of the power transmission means is journalled at axis 12 of roller 6, as is roller shaft 5. The connecting rod 13 at its free end has a joint or link 14. The geometric locus of link 14 is freely selectable and is adapted and is adapted to optimum injection conditions in conformity with the number of revolutions or rotations. The resultant curve is designated by the reference numeral 15. The parameters of the drive mechanism are the length of the roller shaft 5, the lenth of the connecting rod 13, distance 11, and the contour of cam 2.

Figure 2:
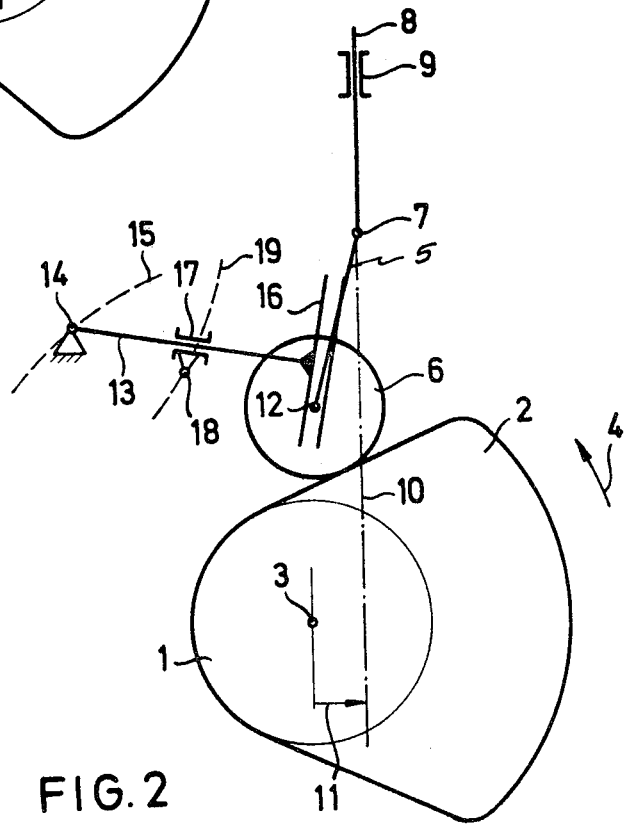

The embodiment according to FIG. 2 shows the roller axis 12 being moved in a parallel guide 16 which is secured rigidly to the connecting rod 13. The parallel guide 16 can be linear or curvilinear. The connecting rod 13 is journalled in a longitudinal guide 17 which is swingable mounted by a joint or link 18. The geometric locus of the link 18 is selectable in relation to the optimum performance graph. The corresponding curve is designated by the numeral 19. A special situation results in that the link 18 is stationary. Furthermore, distance 11 can be zero.

Figure 3:
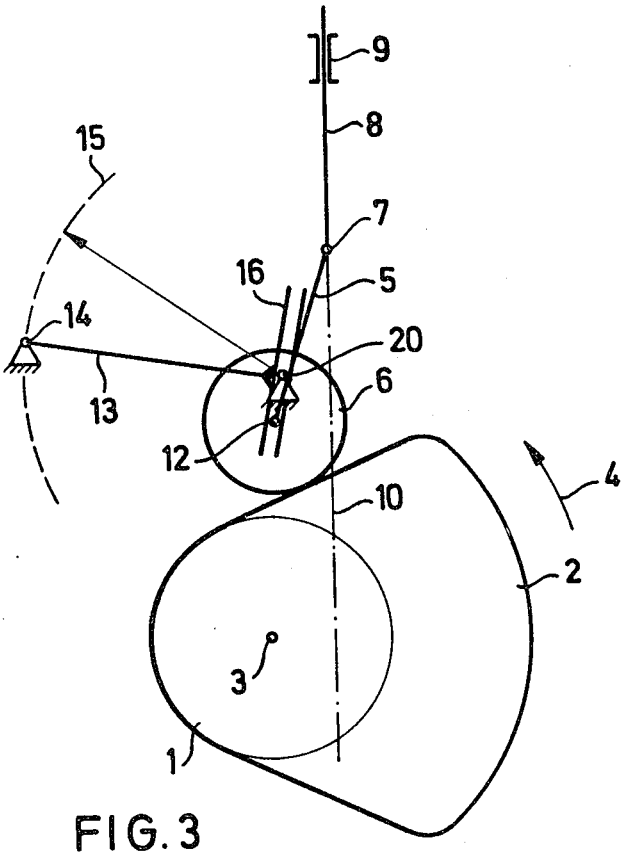

In contrast with the embodiment shown in FIG. 2, in the embodiment according to FIG. 3, the longitudinal guide 17 and the link 18 are replaced by further link or joint 20 attached to the parallel guide 16. The parallel guide 16 is pivotal about link 20 when curve 15 prescribes a circle about link 20.

Figure 4:
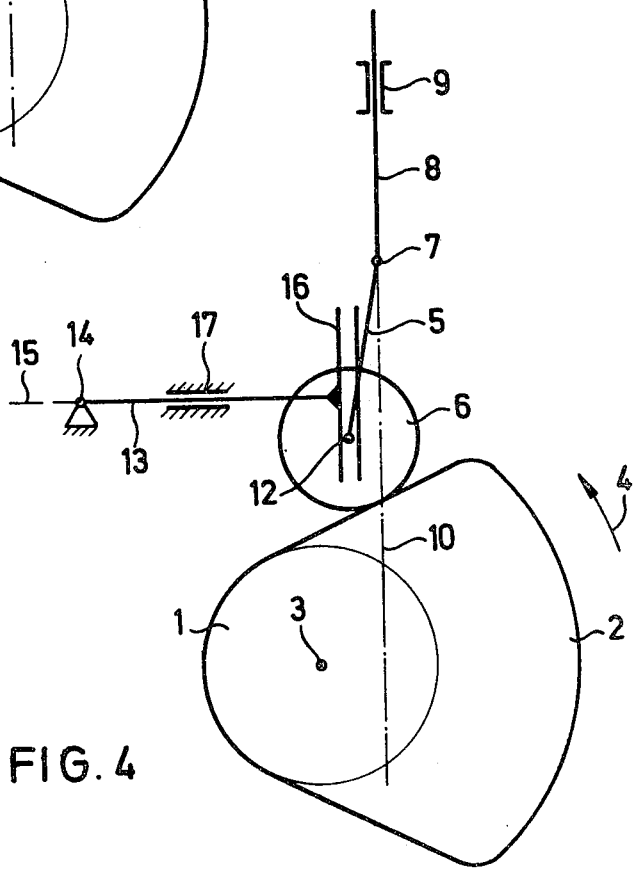

A further special situation is shown in FIG. 4. The longitudinal guide 17 is stationary and the link 18 has been eliminated. The curve 15 is, therefore, a straight line in the direction of the longitudinal guide 17.

Figure 5:
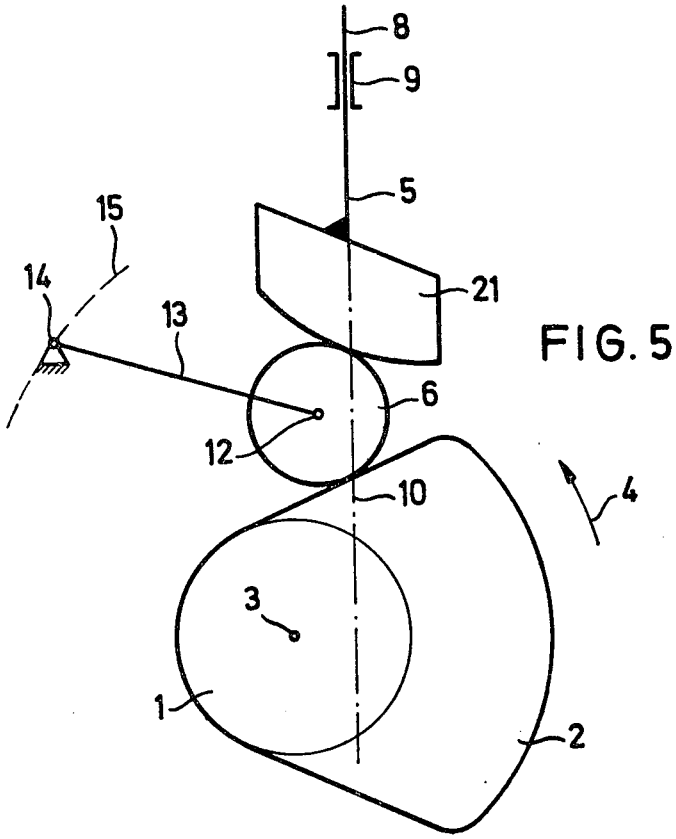

In the embodiment according to FIG. 5, the pump piston 8 is unitary with the roller shaft 5. The roller shaft 5, furthermore, is in contact with roller 6 through a cam plate 21. The roller 6, in turn, is joined to link 14 by the connecting rod 13. The required positive connection between roller 6 and cam plate 21 is provided by a return spring, not shown. The course of the piston stroke and initiation of delivery are dependent on the position of link 14 of the curve 15 and the profile of the cam plate 21.

Figure 6:
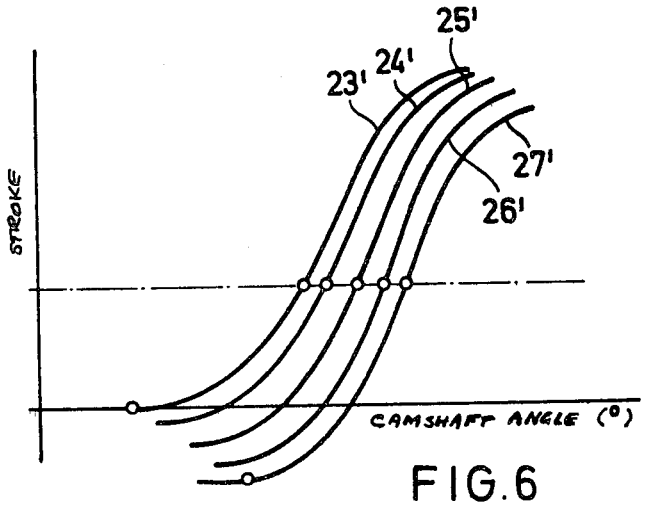
Figure 8:
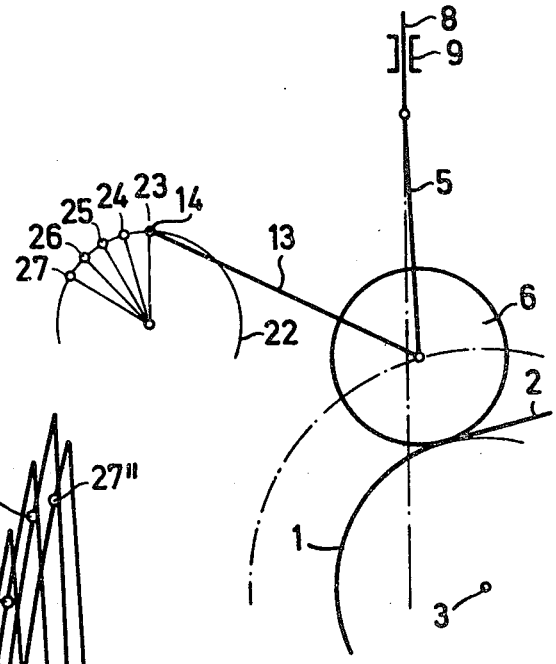
Figure 7:
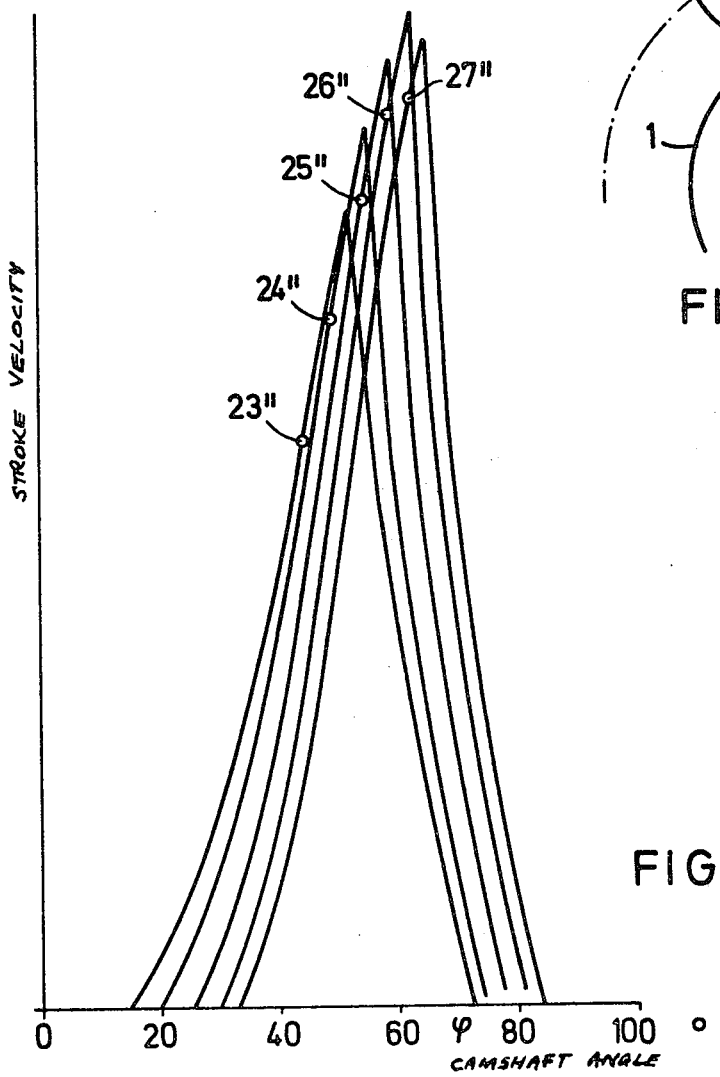
Figure 9:
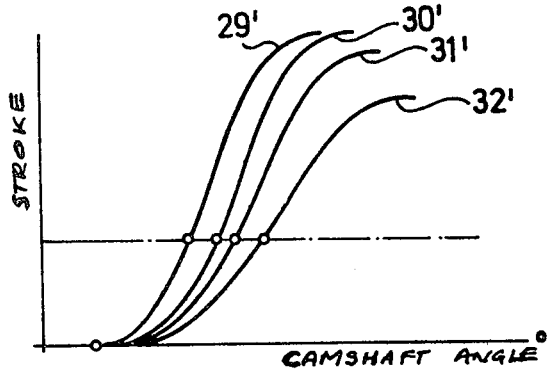
Figure 10:
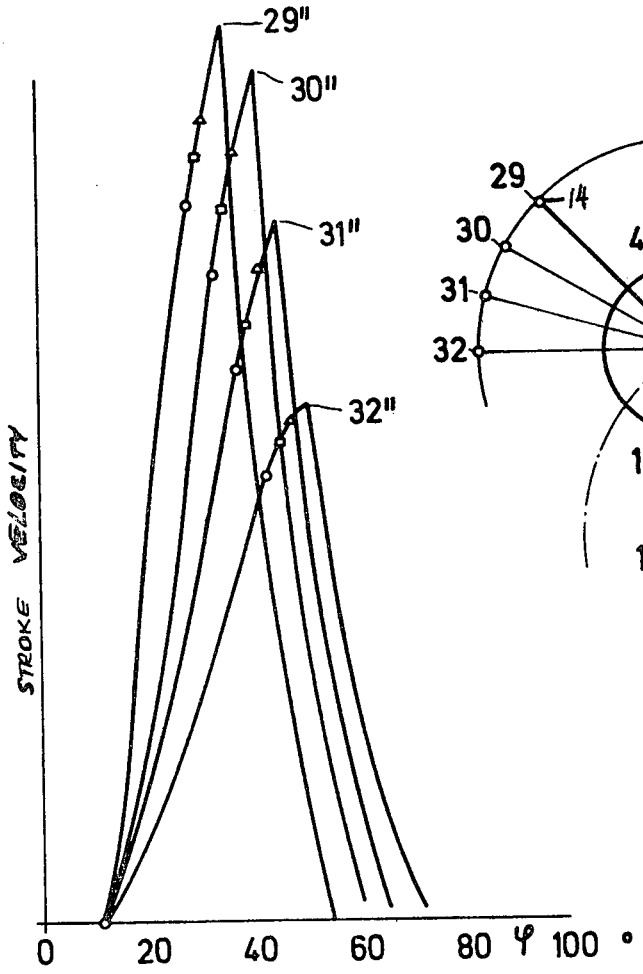

FIG. 6 shows a diagram of the stroke curves of the pump piston of an embodiment in accordance with FIG. 1, whereby the link 14 successively assumes the positions 23 to 27 located on a circle 22. The geometrical correlation is shown in FIG. 8. The corresponding stroke curves in FIG. 6 are designated by the numerals 23 to 27′. FIG. 7 shows corresponding curves for the stroke velocity in conformity with the angle of the cam shaft. These are designated by 23″ to 27″. The stroke velocity here can be kept constant at a ratio of number of revolutions of 1.4 : 1.

Figure 11:
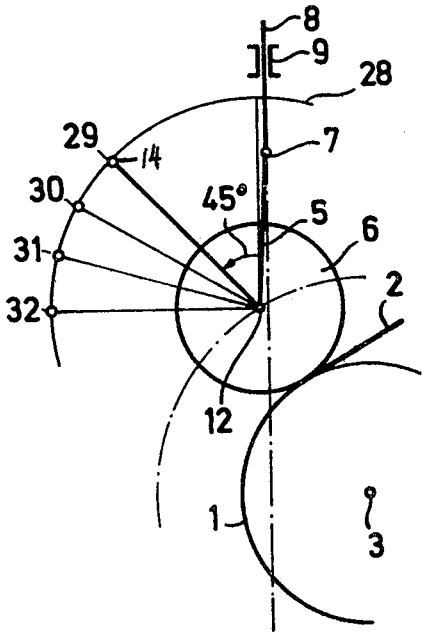

No shifting of the zero point of the stroke curves is obtained when the link 14, of the embodiment according to FIG. 1, as is shown in FIG. 11, is guided along a circular path 28 about the roller axis 12. The positions 29 to 32 in FIG. 11 correspond to stroke curves 29′ to 32′ in FIG. 9 and the stroke velocity curves 29″ to 32″ in FIG. 10. In this example, it is possible to maintain the stroke velocity constant for a number represented by a revolution ratio of 1.6 : 1.

Figure 12:
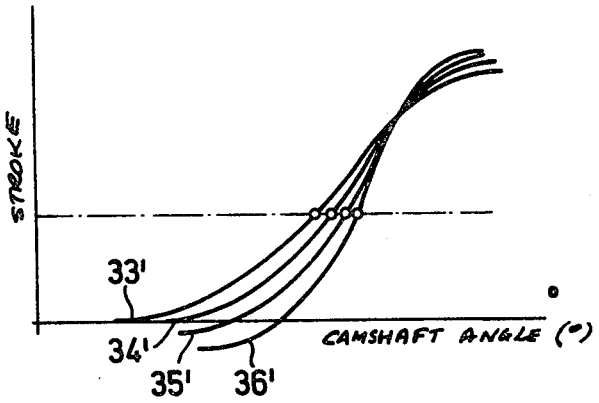
Figure 14:
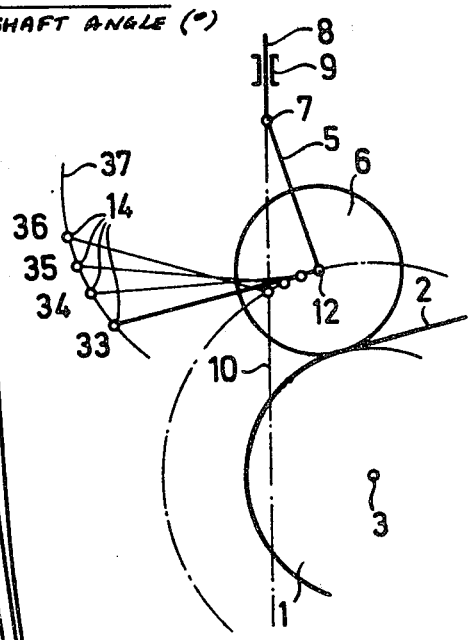
Figure 13:
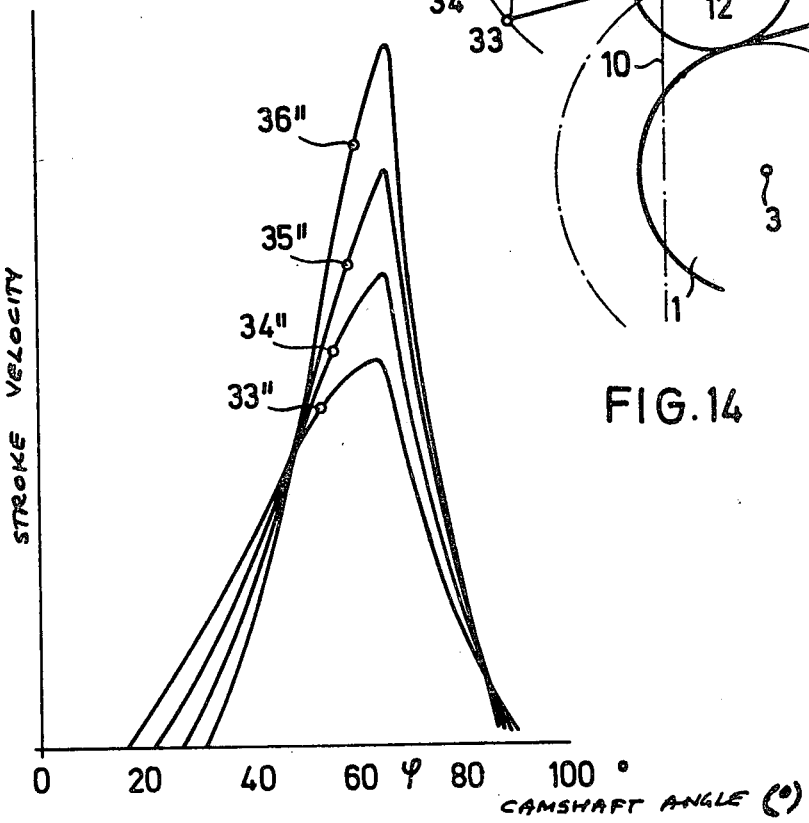

Further variations are shown in FIGS. 12 to 14. The positions 33 to 36 of link 14 along circle 27, having a center near their piston axis 10 in FIG. 14, correspond to stroke curves 33′ to 36′ in FIG. 12 and the stroke velocity curves 33″ to 36″ in FIG. 13. In this embodiment, the stroke velocity can be maintained constant for a number represented by a revolution ratio of 1.7:1.

The present invention is, of course, in no way restricted to the disclosure of the drawings, but also encompasses any modifications within the scope of the appended claims.

What we claim is:

1. A fuel injection pump for internal combustion engines having a mechanically operable camshaft which can generate injection procedure independently of engine speed, comprising in combination:

a cam mounted on said canshaft and arranged to impart a constant lift or stroke;

a pump piston arranged to carry out differently developed lift or stroke inspite of constant lift or said cam as well as including a piston rod and actuable independently of pump drive speed in response to the motion of said cam so that the stroke of said piston is partially utilized for the delivery of fuel, the fuel delivery volume being controllable by varying the overall effective stroke of said pump piston;

control means for changing velocity of the overall effective piston stroke according to the angular attitude of said cam, said pump piston being movable in a pump cylinder chamber, said pump piston having exterior control edges which cooperate with said pump cylinder chamber for limiting the stroke of said pump piston, and including a housing wherein said control means includes;

a cam follower roller, said roller being movable in response to rotation of said cam and in contact therewith;

means for rotatably mounting said cam follower roller;

power transmission means for transmission of motive power to said pump piston, said power transmission means having a first end operatively connected to said pump piston and a second end adjustably connected to said housing, said power transmission means including at least a cam lever drive unit operatively associated therewith;

a first guide means having parallel sides for guiding said shaft means for said cam follower roller;

a connecting rod having first and second ends, whereby said first end of said connecting rod is secured to said first guide means;

a second swingable guide means for controlling movement of said connecting rod; and link means secured to the second end of said connecting rod for displacing said other end of said connecting rod in conformity with the number of revolutions of the combustion engine.

2. A fuel injection pump according to claim 1, wherein the geometric locus of the swingable connecting rod guide means is movable on a curve.

3. A fuel injection pump according to claim 2, wherein said swingable connecting rod guide means is movable in conformity with the number of revolutions of said combustion engine.

4. A fuel injection pump, according to claim 1, wherein said lever means includes at least one lever connected with an end to said pump piston and further including:

a cam plate secured to the other end of said at least one lever so as to be in cam following contact with said cam follower roller; and a connecting rod having first and second ends whereby said first end is journalled at said shaft means, and said second end is in the form of a link means for displacing the second end of said connecting rod in conformity with the number of revolutions of said combustion engine, whereby the geometric locus of said link means is movable on a curve.

* * * * *